US005246390A

United States Patent [19]

Egenolf

[11] Patent Number: 5,246,390

[45] Date of Patent: Sep. 21, 1993

[54] ELECTRICAL CONTACT

[75] Inventor: Bernhard Egenolf, Dreieich-Sprendlingen, Fed. Rep. of Germany

[73] Assignee: The Whitaker Corporation, Wilmington, Del.

[21] Appl. No.: 888,235

[22] Filed: May 22, 1992

[30] Foreign Application Priority Data

Jun. 3, 1991 [DE] Fed. Rep. of Germany ..... 9106773

[51] Int. Cl.[5] ..... H01R 13/15

[52] U.S. Cl. ..... 439/839

[58] Field of Search ..... 439/839, 745, 847

[56] References Cited

U.S. PATENT DOCUMENTS 4,534,610 8/1985 Takihara ..... 439/839
4,699,444 10/1987 Isohata ..... 439/839
4,834,681 5/1989 Chaillot ..... 439/856

FOREIGN PATENT DOCUMENTS

0196367A1 4/1985 European Pat. Off. .

OTHER PUBLICATIONS

English Translation of French Patent Application 2,627,020.

*Primary Examiner*—Gary F. Paumen
*Attorney, Agent, or Firm*—Eric J. Groen; Timothy J. Aberle

[57] ABSTRACT

An electrical contact adapted for plugging connection, comprising a pair of contact spring arms and an outer back-up spring having a pair of outer back-up spring arms disposed on the outside of the contact spring arms. For reducing the insertion force for a tab contact insertable into contact, the two outer back-up spring arms are held by a spacing means at such a minimum spacing from each other that the contact spring arms come into abutment with the respectively associated outer back-up spring arm only after having been spread apart to a predetermined distance from each other.

8 Claims, 5 Drawing Sheets

ELECTRICAL CONTACT

BACKGROUND OF THE INVENTION

1. Field of the Invention

The invention relates to an electrical receptacle contact having at least one pair of contact spring arms with an outer back-up spring including an outer back-up spring.

2. Description of the Prior Art

An electrical contact of this type is known from German Patent Specification 32 48 078. Such electrical contacts usually are stamped in one piece from sheet metal and subjected to bending operations so as to form the pluggable contact. The contact spring arms thus consist of the same material and have the same thickness as the remaining portions of the contact. The spring force of the contact spring arms attainable in this manner often is not sufficient. This is why the desired spring force is generated with the aid of an outer back-up spring whose outer back-up spring arms press against the contact spring arms from the outside.

When the complementary contact inserted between the contact spring arms is a tab contact, the contact locations of the contact spring arms thus engage both sides of the tab contact with a contact force which does not only amount to the spring force of the contact spring arms, but to the sum of the spring forces of contact spring arms and outer back-up spring arms. Due to the fact that the type and thickness of the material for the outer back-up spring need not be selected depending on the material and the material thickness of the contact, such an outer back-up spring, in comparison with a contact having no such outer back-up spring, is capable of obtaining a considerable increase in the contact force that can be exerted by the contact spring arms on a tab contact inserted therebetween. Therefore, a high contact force and thus good and reliable electrical contacting can be achieved between contact and tab.

However, this advantage is obtained with the sacrifice that a correspondingly high mating force must be applied for mating receiving contact and tab contact. This becomes a problem in particular with multi-pole connectors having a multiplicity of such contacts. When such a multi-pole connector is mated with a complementary connector having a corresponding number of tab contacts, a mating force must be applied which instantly corresponds to the sum of the spring forces of all contact spring arms and of the spring forces of all outer-back up spring arms.

SUMMARY OF THE INVENTION

It is the object of the invention to make available an electrical contact with an outer back-up spring, which renders possible a considerable reduction of the necessary mating force while maintaining the high contact force achievable with such outer back-up springs.

With an electrical contact of the type indicated at the outset, this object is met in that the free ends of the outer back-up spring arms are held by a spacing means at such a minimum distance from each other that the contact spring arms come into abutment with the respectively associated outer back-up spring arm only after having been spread apart to a predetermined distance from each other which is smaller than the thickness of the tab contact, and in that the spacing means permits spreading apart of the outer back-up spring arms beyond said minimum distance. In a preferred embodiment of the invention, the back-up spring arms, in the direction of their width, have a projecting width extension on both sides of the respectively associated contact spring arm, and a spacing projection projects in the region of each extension between the opposing outer-back up spring arms to such a depth that the spacing projection does not contact the contact spring arms. The width of the spacing projection in the direction of the resilient motion of the outer back-up spring arms corresponds to the desired minimum distance to which the outer back-up spring arms are to be spaced apart by the spacing means. Preferably, the spacing projections are provided in the form of spacing lugs cut out from sidewalls of the contact and/or of the outer back-up spring and bent into the region between the projecting extensions of the outer back-up spring arms.

Further developments of the contact according to the invention are indicated in the dependent claims.

DETAILED DESCRIPTION OF THE PREFERRED EMBODIMENTS

Figure 1:
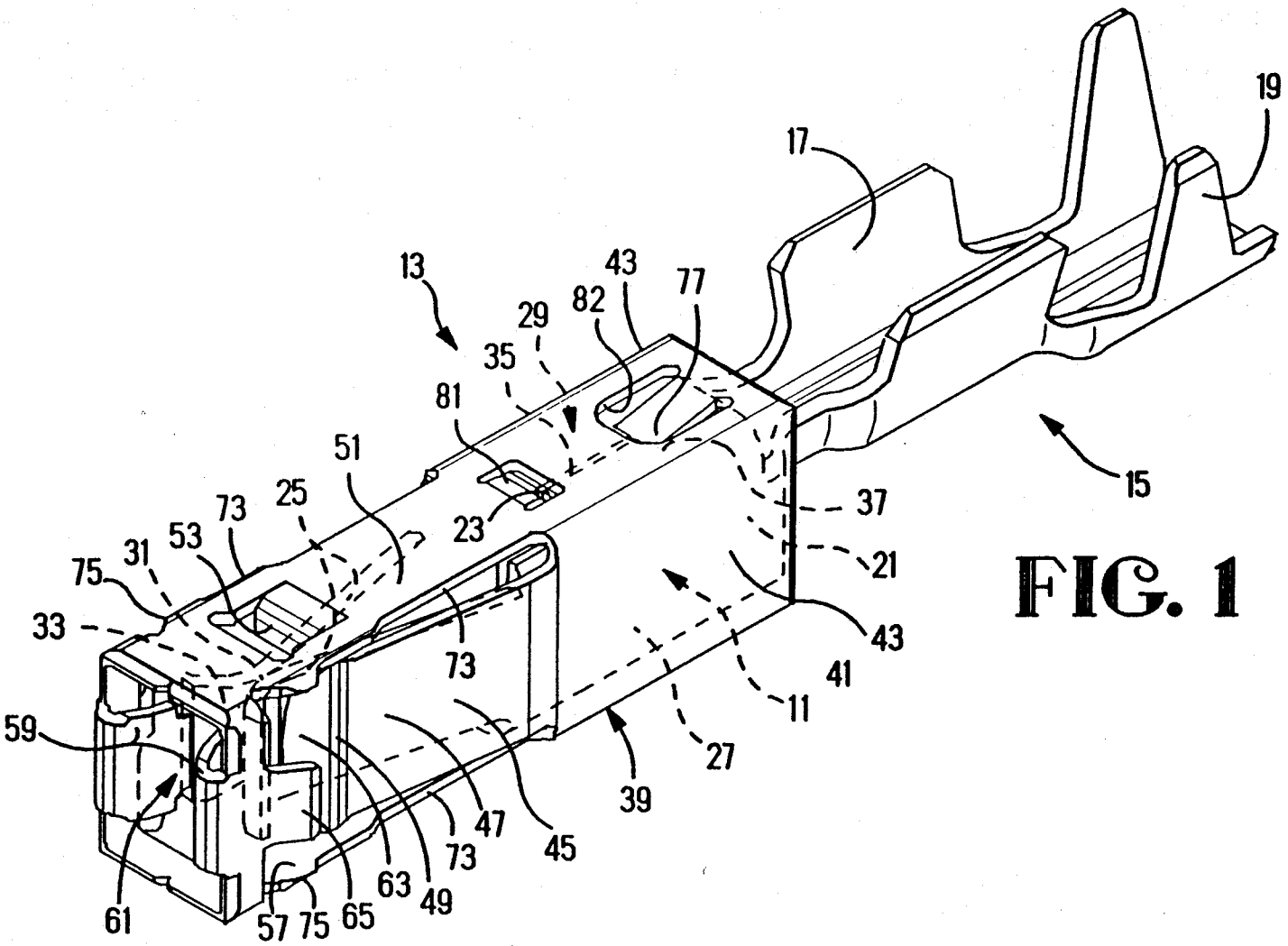
FIG. 1 shows a perspective side view of a contact according to the invention.

FIG. 1 shows a contact 11 adapted for plugging connection, which is constructed in the form of a receptacle contact and is provided with an outer back-up spring 13. Those portions of contact 11 that are hidden by the outer back-up spring 13 are shown in broken lines.

Contact 11 comprises a wire terminating portion 15 having in known manner a conductor crimping zone 17 and an insulating crimping zone 19. Conductor crimping zone 17 is crimped onto a stripped electrical conductor of an electrical wire. Insulation crimping zone 19 is crimped onto the remaining insulating jacket of the wire.

Contact 11 comprises a contact body 21 following said wire terminating portion 15 and, in the embodiment shown, being provided in the form of a closed box of substantially rectangular cross-section. A pair of contact spring arms 25 projects from the mating-side longitudinal end 23 of contact body 21. Each of the two contact spring arms 25 constitutes an integral continuation of one of two opposing sidewalls 27, 29 of the contact body 21.

The contact 11 shown in the figures is a single flat spring contact. However, it could also be provided in the form of a double flat spring contact, in which two contact arms each would project from each of the two sidewalls 27, 29 of contact body 21.

The two contact spring arms 25 extend towards each other in converging manner until they contact each other in a line of contact 31. On the side of the contact line 31 located on the mating side, the free ends of contact spring arms 25 diverge so as to form an insertion funnel 33. The insertion funnel 33 facilitates insertion of a flat contact, which often is also referred to as tab contact.

Due to the fact that contact 11 is stamped and formed from one single piece of sheet metal, the box-shaped contact body 21 thereof has an abutment seam 35 extending in the longitudinal direction thereof. In the embodiment shown in FIG. 1, the abutment seam is located in the, with respect to FIG. 1, upper wall of contact body 21, which will be referred to as top part 37 hereinafter.

The outer back-up spring 13 comprises an outer backup spring body 39. The outer back-up spring 13 extends from the wire-terminating-side end of contact body 21 beyond the free ends of the insertion funnel 33 of the contact spring arms 25. Outer back-up spring body 39 comprises a box-portion 41 of substantially rectangular, closed box-shape, which is seated on the contact body 21 and encloses the same. One outer back-up spring arm 45 each is cut free from opposing sidewalls 43 of the outer back-up spring body 39. The two outer back-up spring arms 45 coming from box portion 41 converge at a first angle of convergence. Starting from a bending line 47 in the vicinity of the free ends 49 thereof, the two outer back-up spring arms 45 converge at a greater angle of convergence.

From top part 51 of the outer back-up spring body 39, which is shown on top in FIG. 1, a spacing lug 53 is cut free and is bent with its free end into the interior of the outer back-up spring body 39 at right angles with respect to top part 51. As can be seen best from FIG. 4, the outer back-up spring arms 45, in the longitudinal direction of the bent portion of said spacing lug 53, are of greater width than the contact spring arms 25, such that the outer back-up spring arms 45 in terms of width project on both sides in the form of extensions 55 beyond the longitudinal edges of the contact spring arms 25. The depth of the portion of the spacing lug 53 projecting between the outer back-up spring arms 45 is selected such that the spacing lug 53 does not extend downwardly as far as to reach the contact spring arms 25.

Figure 4:
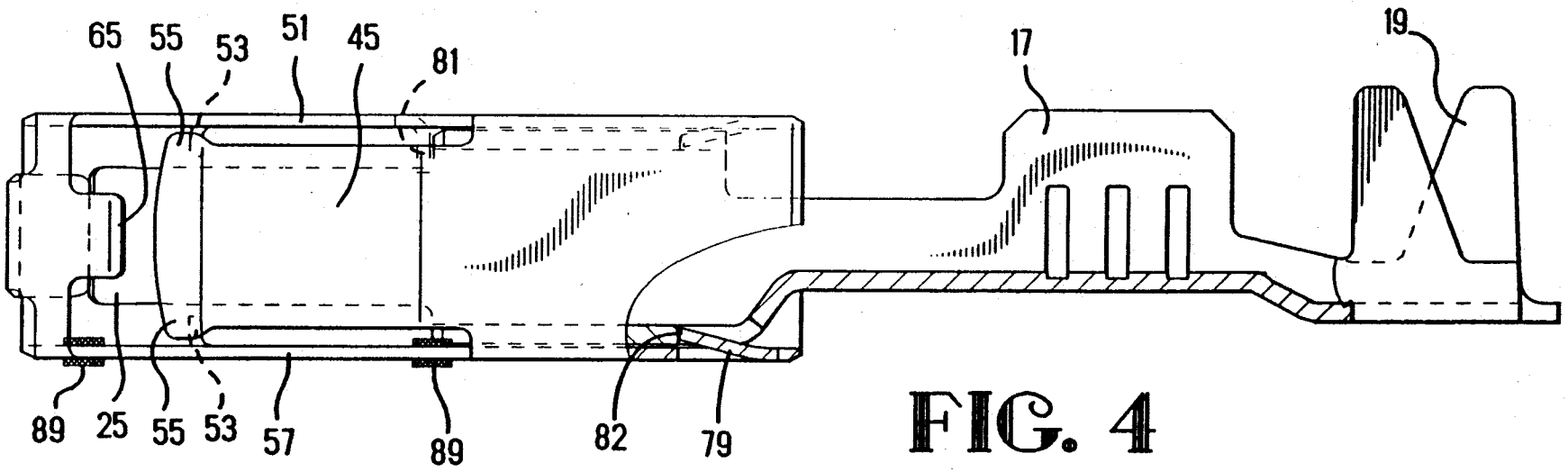
FIG. 4 shows a longitudinal side view of this contact.

As can be seen best from FIG. 4, a spacing lug 53 does not only extend from the top part 51 of the outer back-up spring body 39, but a spacing lug 53 extends also from the bottom part 57 thereof between the lower projecting extensions 55 of the two outer back-up spring arms 45.

The spacing lugs 53 are positioned in the longitudinal direction of extension of the outer back-up spring 13 such that they come to lie between the outer back-up spring arms 45 in the region of bending line 47.

Figure 2:
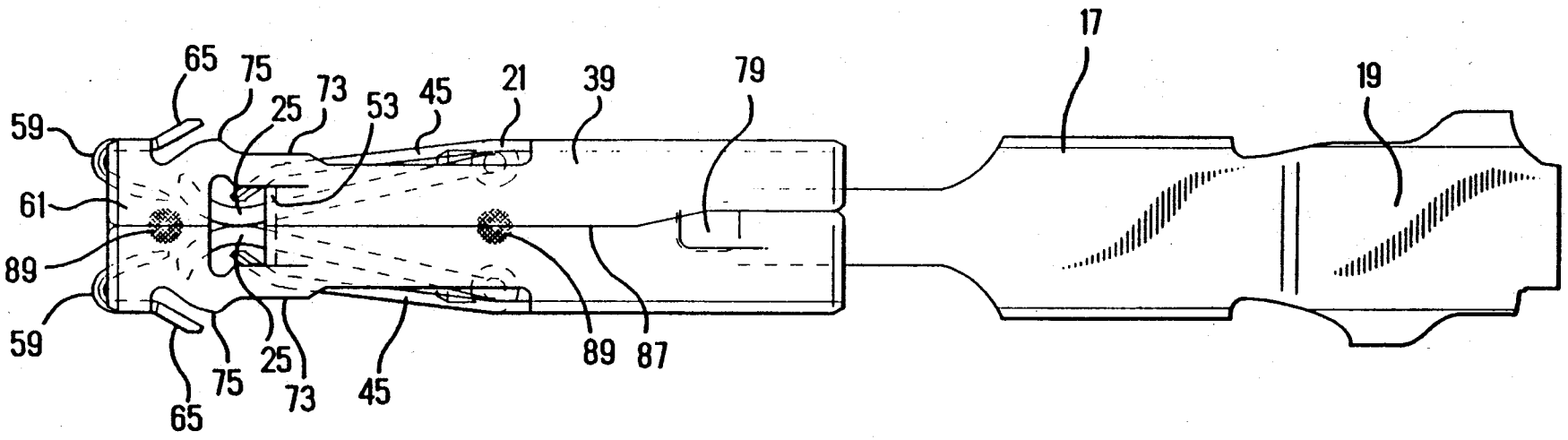
FIG. 2 shows a bottom plan view of a contact substantially identical with that of FIG. 1.
Figure 3:
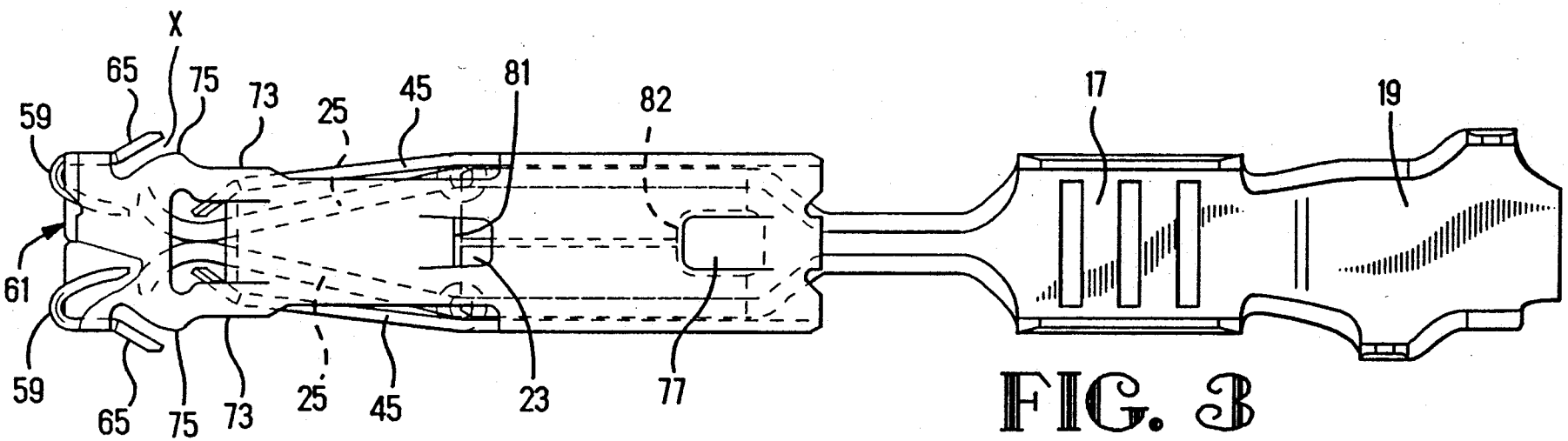
FIG. 3 shows a top plan view of said contact.

As can be seen best in FIGS. 2 and 3, the free ends of the outer back-up spring arms 45 are located substantially at the level of the contact line 31 of the contact spring arms 25, but are held spaced from the contact spring arms 25 by said spacing lugs 53.

When a tab contact (not shown in the drawings) is inserted between the opposing contact spring arms 25, this causes the two contact spring arms 25 to be spread apart, which at first is countered only by the spring force of the two contact spring arms 25. During further insertion of the tab contact between the contact spring arms 25, the contact spring arms 25 finally come to abut the free ends of the outer back-up spring arms 45. Upon still further insertion, not only the contact spring arms 25 but also the outer back-up spring arms 45 are spread apart. During this last phase of the insertion operation, the sum of the spring forces of the contact spring arms 25 and of the outer back-up spring arms 45 counteracts such spreading apart. Starting with this moment of time, a contact force corresponding to the sum of these two spring forces is produced between the receptacle contact 11 and the tab contact.

The width of the spacing lugs 53 in spreading direction of the outer back-up spring arms 45 is selected such that the spreading gap between the two contact spring arms 25 in contact line 31 is slightly smaller than the thickness of the tab contact. The effect achieved by such dimensioning is that, during the largest part of the insertion operation, only the relatively low spring force of the contact spring arms 25 becomes effective, and the sum of the spring forces of the contact spring arms 25 and of the outer back-up spring arms 45 becomes effective only in the end phase of the insertion operation.

Projecting from the mating-side ends of the sidewalls 43 of the outer back-up spring body 39 are extended portions 59 bent into the mating-side end of the outer back-up spring body 39 with such convergence of the free ends thereof towards each other that an auxiliary funnel 61 is formed. Auxiliary funnel 61 facilitates insertion of the tab contact into the insertion funnel 33 of the contact spring arms 25.

Figure 5:
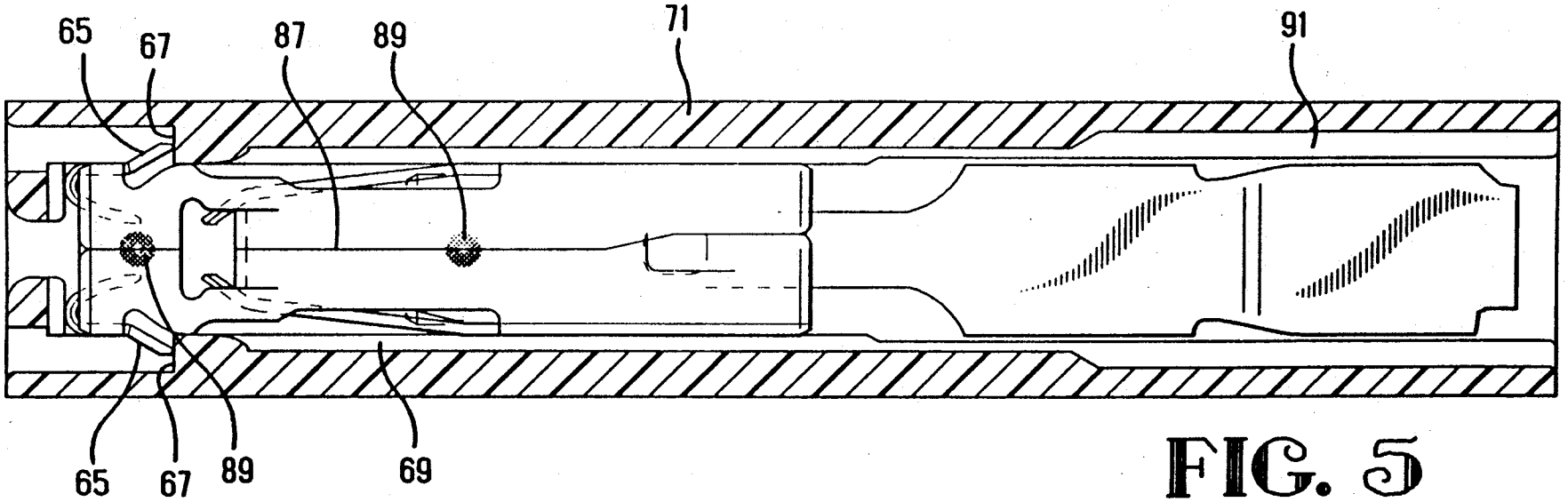
FIG. 5 shows a sectional view of an insulating housing having receiving chambers, illustrating one such chamber having a contact according to the invention inserted therein.

Extending from the mating-side ends of the cut-free openings 63, produced in conjunction with the cutting-free of the outer back-up spring arms 45, are locking lances 65 which project obliquely outwardly and have their free ends directed towards the wire terminating portion 15. These lances cooperate with locking shoulders 67 formed at corresponding locations of associated contact receiving chambers 69 in a connector housing 71 of insulating material, as shown in FIG. 5.

The locking lances 65 preferably are of short length, preferably in the range from about 10 to 20 percent of the length of the contact spring arms 25.

Locking lances for locking electrical contacts in the contact receiving chambers of connector housings are usually provided in the region of the contact body 21, i.e. in the vicinity of the wire terminating portion 15 and thus approximately in the longitudinal center of the contact as a whole, or even at the wire-terminating-side longitudinal end of the contact. The electrical wires extending from the wire terminating portions of contacts of a connector are often subjected to transverse forces during operation. These forces result in that a contact concerned performs pivotal motions transversely of its longitudinal direction, with the pivot axis of this pivotal motion being located in the region of the locking lances. When the locking lances are disposed in conventional manner in the longitudinal center or even at the wire-terminating-side end of the contact, such transverse forces acting on the terminated wire lead to a correspondingly high pivotal motion of the longitudinal end of the contact on the mating side. These strong pivotal motions cause an undesired mechanical load of the connection between receptacle contact and tab contact.

This problem is overcome by the arrangement of the locking lances 65 on the mating-side end of the outer back-up spring body 39 according to the invention. Due to the fact that the rotational axis for pivotal motions as a result of transverse forces applied to a crimped terminated wire is now located at the mating-side end of the outer back-up spring body 39 and thus of contact 11, the contact portion between contact spring arms 25 and the tab inserted therebetween remains substantially unaffected by such pivotal motions. The mechanical loads mentioned are thus largely avoided. Furthermore, it is possible to allow more tolerance play between the contact spring arms 25 and the tab inserted therebetween. Due to the fact that the contact portion between the contact spring arms 25 and the tab inserted therebetween must be designed for transmitting a specific current intensity that is dependent on the particular application, the contact spring arms 25 and the tab must overlap each other by a minimum width in all instances of movement for being able to transfer this current intensity across the contact location. Since, when the locking lances are positioned according to the invention, only a slight pivotal motion can occur when transverse forces act on the terminated wire, the risk is low that the contact-establishing overlapping portion between the contact spring arms 25 and the tab changes significantly due to the pivotal forces acting on the wire terminating portion 15. This allows more tolerance play between the contact spring arms 25 and the tab than in case of stronger pivotal motions as they may occur when the locking lances are positioned in the center or even at the wire terminating end of the contact.

As is clearly gatherable from FIGS. 1 to 3, the longitudinal edges 73 both of top part 51 and of bottom part 57 of the outer back-up spring body 39 are each provided with an outwardly directed convex bulge 75 in the region of their mating-side ends. The convex bulges are of such a shape that the distance x between their outer contour and the respectively adjacent locking lance 65, as seen when projecting this locking lance 65 into the plane of the top part 51 or bottom part 57, respectively, provided with the bulge concerned, is smaller than the thickness of the thinnest wire to be terminated to contact 11 or another contact of the same connector housing. This prevents tangling of wires in the locking lances 65. This is a serious problem with contacts having conventional locking lances which often are not only considerably longer than the present locking lances 65 but are not provided, either, with a tangling projection for wires in the form of the bulge 75. Such tangling occurs often and is a nuisance in making and handling cable harnesses the lines of which are terminated to contacts like the contact concerned herein, especially when the production of such harnesses and the termination of contacts to the wires thereof is made by means of automatic machines.

The bulges 75 have a further function. They render possible exact guiding of the contact 11 provided with the outer back-up spring 13 in the contact receiving chamber 69. The bulges 75 can be defined very well in the stamping operation as regards their dimensions. The contact 11 provided with the outer back-up spring 13 thus can be positioned very well within the contact receiving chamber 69.

The bulges 75 result in that the contact 11 provided with the outer back-up spring 13 is supported in the contact zone of contact 11. In case of a tumbling motion of the contact 11 provided with the outer back-up spring 13 in the contact receiving chamber 69, e.g. because of transverse forces acting on the wire terminated thereto, the contact zone thus remains at rest. Other portions of the contact 11, in particular the wire terminating portion 15, are free to tumble. Therefore, a space 91 can be left free in the contact receiving chamber 69 outside of the portions cooperating with the bulges 75. This facilitates introduction of the contact 11 provided with the outer back-up spring 13.

The outer back-up spring 13 is adapted to be snapped onto contact 11. To this end, a locking lance 77 and 79 is provided both in the top part 51 and in the bottom part 57, respectively, and a locking stop 81 is provided in top part 51 of the outer back-up spring body 39. The locking lances 77, 79 and the locking stop 81 are each struck out from the top part 51 and the bottom part 57, respectively, and are bent into the interior of the outer back-up spring body 39. While locking stop 81 extends vertically into the interior of outer back-up spring body 39, locking lances 77 and 79 project obliquely into the interior of outer back-up spring body 39, with the free ends of the locking lances 77, 79 being directed towards the mating-side end of the outer back-up spring body 39.

In the embodiment shown in FIG. 1, the locking lances 77, 79 are cut free from the top part 51 and the bottom part 57, respectively, and then are bent into the box portion 41 of the outer back-up spring body 39. FIGS. 2 to 5 show an embodiment that is modified with respect to the locking lances 77, 79. In this embodiment, the locking lances 77 and 79 are each formed in that a corresponding portion of the top part 51 and the bottom part 57, respectively, has been sheared through and pushed inwardly into the interior of the box portion 41. The locking stop 81 can be formed in the same manner.

A further possibility consists in forming the locking projections by pushing the corresponding portion of the outer back-up spring inwardly in non-shearing manner, i.e. by forming a recess by inwardly directed pressure.

The resiling effect desired for the locking projections 77 and 79 is rendered possible in this embodiment by the resilience of the part of the outer back-up spring surrounding the respective locking projection.

When the outer back-up spring body 39 is snapped onto contact 11, the locking stop 81 is located opposite a transverse edge at the mating-side end of contact body 21, said transverse edge being constituted by the longitudinal end 23 on the mating side. The free ends of the locking lances 77 and 79 are each located opposite a transverse edge 82 on the wire terminating side, with the latter edge being formed by a cutout in the wire-terminating-side end of the top part 37 and the bottom part 83 of the contact body 21, respectively.

The wire-terminating-side transverse edges 82 cooperating with the free ends of the locking lances 77 and 79 may also be constituted by the wire-terminating-side ends of the top part 37 and the bottom part 83 of the contact body 21, respectively. The angle between the locking lances 77, 79 and the top part 51, respectively the bottom part 57, of the outer back-up spring body 39 is selected such that the free ends of the locking lances 77, 79, in the unstressed condition, are located at the level of the transverse edges 82 on the wire terminating side.

For mounting to contact 11, the outer back-up spring is slid onto the contact 11 from the mating-side free ends of the contact spring arms 25. When, in doing so, the locking lances 77 hit the mating-side longitudinal ends 23 of contact body 21, these lances evade in resilient manner and slide across top part 37 and bottom part 83 of contact body 21, until the free ends thereof have passed across the transverse edges 82 on the wire terminating side and the locking lances 77 and 79 are allowed to return into their unstressed position. In doing so, locking stop 81 cooperates with the mating-side longitudinal end 23 of the top part 37 of the contact body 21 in such a manner that a further sliding motion of the outer back-up spring 13 in the direction towards wire terminating portion 15 is prevented. A backward sliding motion of the outer back-up spring 13 in the direction towards the mating-side end of the contact 11 is prevented by the cooperation between the locking lances 77, 79 and the transverse edges 82. The outer back-up spring 13 is in this position snapped onto contact body 21 and is locked there.

An operation such as moving locking lances disposed on the outer back-up spring into associated locking recesses on the contact, or bending of locking lances of the outer back-up spring about web portions of the contact is not necessary any more with the design of contact and outer back-up spring according to the invention. All operations on contact 11 and outer back-up spring 13, which serve for the locking process, can thus be carried out while contact 11 and outer back-up spring 13 are still separated from each other, preferably even on the flat stamped blanks before these are bent into the shape of contact 11 and outer back-up spring 13, respectively.

The outer back-up spring 13 has been created by bending a stamped sheet metal part in the form of a box. An abutment joint 87 formed during such bending is closed by welding. Preferably, a laser spot welding process is used therefor. Two welding spots 89 are shown in FIGS. 2 and 4.

By the configuration of the outer back-up spring body 39 according to the invention such that it encloses the contact spring arms 25 across the entire length thereof, good protection of the contact spring arms 25 against damage thereof is provided at the same time.

The rounded corners and edges, for instance in the root portion of auxiliary funnel 61, render possible easy insertion of the contact 11 provided with outer back-up spring 13 into a contact receiving chamber 69 of connector housing 71.

Due to the fact that the wire-terminating-side end of the outer back-up spring body 39 projects at the four longitudinal sides thereof beyond the contact body 21, there is the possibility that secondary locking means, formed on or in connector housing 71 and engaging only in the closed condition behind an edge or a shoulder of the contact or the outer back-up spring, can engage in arbitrary manner on the wire-terminating-side end of each of the four longitudinal sides of the outer back-up spring body 39.

I claim:

1. An electrical contact comprising:

a contact body having at least one pair of contact spring arms extending therefrom for receiving a tab contact therebetween;

said contact body including an outer back-up spring with an outer back-up spring body having at least one pair of outer back-up spring body arms extending therefrom and including at least one free end on each said arm, wherein each of said arms extend along an outside surface of an associated contact spring arm, characterized in that the free ends of the outer spring arms resiliently engage a spacing projection formed on said outer spring body and are thereby spaced apart from said contact spring arms at a minimum distance;

whereby, the contact spring arms come into engagement with the respective outer back-up spring arms only after having been spread apart to a predetermined distance smaller than the thickness of the tab contact.

2. A contact according to claim 1, characterized in that the outer back-up spring arms at least in the vicinity of the spacing means have a greater width than the contact spring arms and thus on at least one longitudinal side have a projecting width extension beyond the contact spring arms, that the spacing projection protrudes in the region of said projecting extension between the opposing outer back-up spring arms to such a depth that it does not contact the contact spring arms, and in that the spacing projection, in the direction of the resilient motion of the outer back-up spring arms, has a width corresponding to the minimum distance.

3. A contact according to claim 2, characterized in that the spacing projection is constituted by a spacing lug bent from the outer back-up spring between the associated projecting extensions of the outer back-up spring arms.

4. A contact according to claim 3, characterized in that the outer back-up spring body, on at least one longitudinal side thereof having no outer back-up spring arm extending therefrom, is provided with an extended portion which is directed towards the mating-side end of the contact and from which the spacing lug extends.

5. A contact according to claim 1, characterized in that the outer back-up spring body having sidewalls in the form of an elongate box extending up to and into the region of the mating-side free ends of the contact spring arms, the outer back-up spring arms being formed out of the sidewalls of said box opposite a pair of broad sides of the contact spring arms, and in that a spacing lug is formed out of at least one of the remaining sidewalls of the outer back-up spring body, the free end of said spacing lug being bent into the interior of the outer back-up spring body thereby defining said spacing projection.

6. A contact according to claim 1, characterized in that the outer back-up spring body has a longitudinal end which projects beyond the free ends of the contact spring arms and is provided at this longitudinal end with extended portions bent into the interior of the outer back-up spring body in a direction towards the free ends of the contact spring arms and together constituting an auxiliary funnel to facilitate insertion of a tab contact.

7. A contact according to claim 5, characterized in that at least one sidewall of the outer back-up spring body is provided with a locking lance having a longitudinal extension portion, and another of said sidewalls is provided with a convex bulge adjacent to the longitudinal extension portion of the locking lance, said bulge being configured such that the space between an outer contour of the bulge and the locking lance, as seen in a projection of the locking lance into the plane of the sidewall formed with the bulge, is narrower than the thickness of an electrical wire to be connected to a wire terminating portion of the contact.

8. A contact according to claim 1, characterized in that the outer back-up spring can be snapped onto the contact.

* * * * *